United States Patent [19]

McMahon

[11] 3,939,834

[45] Feb. 24, 1976

[54] METAL COATED ARTICLES

[76] Inventor: Patrick J. McMahon, 87 Interlaken Ave., New Rochelle, N.Y. 10801

[22] Filed: Sept. 24, 1974

[21] Appl. No.: 508,827

[52] U.S. Cl. ..... 128/272; 215/13 R; 204/298

[51] Int. Cl.[2] ..... A61J 1/00

[58] Field of Search ..... 128/272; 106/3; 117/97, 117/227; 215/3, 13 R, 1 R; 204/192, 298

[56] References Cited

UNITED STATES PATENTS

| | | | |
|---|---|---|---|
| 2,622,598 | 12/1952 | Rosenblum | 128/272 |
| 2,643,021 | 6/1953 | Freedman | 215/13 R |
| 2,825,687 | 3/1958 | Preston et al. | 204/192 |
| 3,779,891 | 12/1973 | Vegh | 204/298 |
| 3,793,167 | 2/1974 | Glaser | 204/298 |
| 3,828,960 | 8/1974 | Walles | 215/13 R |
| 3,833,410 | 9/1974 | Ang | 117/227 |

*Primary Examiner*—Aldrich F. Medbery
*Attorney, Agent, or Firm*—Depaoli & O'Brien

[57] ABSTRACT

A transparent container is provided which is coated on the interior surface with a coherent barrier layer of metal. Stainless steel is a preferred barrier coating for glass equipment adapted to contain biological media.

17 Claims, No Drawings

METAL COATED ARTICLES

BACKGROUND OF THE INVENTION

A variety of techniques have been developed for applying a coherent coating on the interior surface of containers. The coatings are designed to prevent corrosion of the container interior by the contents which are in contact with the interior surface. In many cases, the coating serves as a barrier to prevent contamination of the contents of the receptacle by material which is leached or dissolved out of the container substrate by a liquid medium contained therein.

Silicone treatment of pharmaceutical and other type containers is known in the art, particularly for imparting drain-clear properties. In U.S. pat. No. 2,504,482 a silicone is dissolved in an organic solvent such as chloroform, and the solution is applied to the inner walls of a container and thereafter the container is heat-treated to fuse a film of silicone on the interior surface of the container. U.S. Pat. Nos. 2,504,482 and 2,776,172 describe other methods for silicone coating the interior surface of pharmaceutical vials, and the like.

U.S. Pat. No. 3,337,321 relates to the production of glassware which has improved resistance to chemical attack. This is accomplished by applying an insoluble film on the surface of the of the glass during the blowing and cooling stage of production while the glass surface is in a highly reactive condition. A colloidal sol of alumina, silica or zirconia is preferred for forming the protective surface film on the interior wall of glass containers.

In U.S. Pat. No. 3,452,503 there is described the provision of a hydrogen impermeable container formed of a metal selected from the group of magnesium, palladium and nickel which is coated on the interior surface with a layer of catalytic poisoning sulfide to prevent catalytic dissociation of hydrogen at the metal surface.

U.S. Pat. No. 3,395,997 describes glass vessels which are rendered highly resistant to helium permeation by treating one of the surfaces thereof with cesium. This is accomplished by the heating of the vessel to a temperature between 250° and 400°C., and under high vacuum introducing a decomposable cesium compound into contact with the heated vessel surface thereby deposited a cesium metal coating on the surface.

In U.S. Pat. No. 3,669,719 metal coatings on non-metallic and metallic substrates are prepared by directing a plasma flame at a non-metallic substrate such as a polyimide or a metal substrate such as titanium, and injecting into one of the gas streams entering the plasma flame a copper-nickel-indium alloy in solid particulate form and depositing on the said substrate as an adherent dense coating.

U.S. Pat. No. 3,690,928 describes a method of coating the interior walls of glass bottles by applying a solution of polyvinyl chloride in a volitile liquid solvent containing an organic coupling agent.

U.S. Pat. No. 3,717,498 relates to a method for coating the inside surface of quartz or ceramic containerrs with a diffusion-preventive coating. In the process, a stream of nitrogen saturated with silicone tetrachloride or a stream of silane diluted with nitrogen is passed into a quartz or ceramic container which is heated to a temperature between 500° and 1000°C. When ammonia is added to the gas stream a thin layer of siliconnitride is formed on the interior surface of the container. Or, when oxygen is added to the gas stream, a thin layer of silicon oxide is deposited on the interior surface.

The present invention generally relates to the above described prior art in that it involves the provision of containers which have the interior surface lined with a barrier coating to overcome interaction of the container interior surface with contents in contact with the surface.

In many aspects of research and development work, particularly relating to microbiology, enzymology, and the like, there is involved the handling and storing of minute quantities of complex biological molecules which are to be identified or purified or subjected to other required procedures. In such specialized fields of activity it has been a serious disadvantage that laboratory equipment such as glass test tubes, vials and pipettes often cause contamination of biological fluids, or the walls of the equipment act to absorb biochemical moieties which are present only in trace quantities but which are essential elements in a quantitative determination. For example, proteins are particularly susceptible to absorption by the walls of glass containers.

It has also been found that plastic containers or plastic coated containers also absorb proteins and the like, and have the further disadvantage that invariably plasticizers or additives or low molecular weight polymers are leached into biological fluids as contaminants. Also, plastic containers tend to breath, so that vapor and moisture is transmitted through the container walls in a deleterious manner. Stainless steel or other metallic containers have advantages over glass and plastic containers. However, metallic containers have limited use because in most pharmaceutical and microbiological research and development procedures it is essential that the container be sufficiently transparent to permit viewing of the liquid medium in the container. Hence, there has been a long-term need for a transparent container adapted for handling of biological and other such media without the disadvantage of glass, plastic or metal containers known and used in the art.

It is an object of the present invention to provide a container which is inert to corrosive media contained therein.

It is another object of the present invention to provide transparent laboratory receptacles such as test tubes, centrifuge tubes, erlenmeyer flasks, sealable vials, and the like, which do not have impurities incorporated in the receptacle walls which contaminate liquid media contained in the receptacles.

It is another object of this invention to provide transparent or translucent glass or plastic containers which have an impermeable interior surface, and do not absorb proteins and other biochemical molecules which are present in a biological fluid in minute quantities.

It is a further object of this invention to provide a method for coating the interior of transparent glass and plastic containers without employing severe temperature conditions or using plating or coating solutions.

Other objects and advantages will become apparent from the following description of preferred embodiments of the present invention.

DESCRIPTION OF THE INVENTION

Accordingly, one or more objects of the present invention are accomplished by the sputtering of a thin metallic coating on the interior of transparent or translucent plastic receptacles, such as test tubes or centrifuge tubes.

The metallic coating is continuous and uniform on the entire interior surface of the receptacle. The metallic coating is strongly adherent, and is sufficiently coherent and thick to constitute an impermeable barrier. The metallic coating varies in thickness between about 50 and 1000 angstroms, preferably between about 300 and 600 angstroms. In many cases the coating is essentially invisible. it is important that the metallic coating be impermeable to media constituents such as protein molecules (e.g., enzymes and enzyme inhibitors), and it is highly desirable that the coating be sufficiently transparent or translucent to permit viewing of the receptacle contents. This is essential if visible transformation of the receptacle contents is to be observed, or if the volume is to be calibrated or reagents are to be added, or if aliquots of the receptacle contents are to be removed.

The particular metal which is applied onto the receptacle interior as a coating must be substantially inert to the contents of the receptacle. It must form a nonporous impermeable barrier between the receptacle interior walls and the receptacle contents. Furthermore, since sputtering is a highly preferred method of coating the interior of the receptacles, the metal must be capable of being sputtered with standard sputtering equipment under average conditions (e.g., at a voltage of about 200–2000). Also, the metal must be capable of forming a strongly adherent coating on glass or plastic surfaces.

Metals which are useful as coatings in the practice of the present invention are selected from stainless steel, chromium, gold, nickel, platinum, palladium, rhodium, vanadium, cadmium, tin, tantalum, tungsten, and the like. Alloys such as those of titanium-vanadium can also be employed.

The preferred metals are stainless steel, chromium, gold and nickel; and of these, stainless steel and chromium are highly preferred for coating glass and plastic receptacle interiors by sputtering techniques.

It is particularly preferred, for example, to coat the interior of glass test tubes and sample vials with stainless steel. These are then useful in the same manner as the corresponding stainless steel equipment and with all the advantages of such equipment, and with the additional unique advantage of being transparent or translucent for the viewing of receptacle contents. Such containers are also advantageous in that they may be cleaned in standard laboratory dishwashers without degradation of the metallic film.

Other methods besides sputtering can be practiced to accomplish the metallic coating operation. For example, the coating can be applied to a substrate by evaporation from a filament under high vacuum conditions.

As mentioned hereinabove, the present invention is particularly suitable for the provision of metallic coated glass and plastic receptacles and containers adapted for use in pharmaceutical and microbiological research and develpment laboratories. These include test tubes, sample tubes, sealable vials, centrifuge tubes, erlenmeyer flasks, beakers, round bottom reaction flasks, pipettes, petri dishes, watch glasses, and the like.

Transparent or translucent plastic receptacles and containers generally are produced from thermoplastic polymers such as cellulose esters, polyacrylate and polymethacrylate homopolymers and copolymers, polyethylene, polypropylene, polycarbonates, polyimides, polyvinyl halides, polyvinylidene halides, polystyrenes, and the like.

The following examples are further illustrative of the present invention. The reactants and other specific ingredients are presented as being typical, and various modifications can be devised in view of the foregoing disclosure within the scope of the invention.

EXAMPLE 1

Equipment is assembled which is suitable for symmetrical AC sputtering.

Two thin (0.062 inch) stainless steel rods are set approximately 0.2 inch apart and inserted into the interior of a standard glass test tube. The rods are insulated from each other and from the test tube.

The test tube is evacuated and argon gas is introduced to a pressure of about 400 microns. High voltage AC (600–1200 volts) is connected across the stainless steel target rods. Material is sputtered from each targon rod on alternate half cycles of the AC voltage, and within 2 minutes the entire interior surface of the test tube is coated with a transparent coherent layer of stainless steel.

The coating operation can also be achieved by DC sputtering, either with two thin rods, or with one rod coaxial with a cylinderical screen.

In the case where a large volume of receptacles are to be interior coated simultaneously, RF sputtering is preferred, employing an assembly of individual rods for sputtering connected to a grounding system outside the receptacles.

EXAMPLE 2

A glass test tube is interior coated with a coherent transparent layer of stainless steel in accordance with the procedure of Example 1.

An aqueous solution of a hormone is prepared and introduced into stainless steel coated test tubes. The hormone is "vaso pressin," which is also referred to as the "anti-diuretic" hormone. The concentration of the hormone in solution is about 100 PPM.

After several minutes, the aqueous solution is removed from the test tubes and the loss of hormone from the solution is determined. The procedure is repeated with standard glass test tubes, plastic test tubes, teflon-coated glass test tubes.

The loss of hormone by absorption into the interior surface of the test tubes is over 80% in the glass test tubes, and the loss is even greater in the case of the plastic test tubes and the teflon-coated test tubes. With the test tubes of the present invention, wherein the interior surface is coated with a coherent layer of stainless steel, the loss of hormone by absorption is less than 10%.

What is claimed is:

1. A container for biological media comprising a transparent or translucent receptacle having the interior surface coated with a coherent light transmitting barrier layer of metal selected from stainless steel, chromium, gold, nickel, platinum, palladium, vanadium, cadmium, tin, tantalum and tungsten.

2. A container for biological media which is sufficiently light transmitting for viewing container contents and which has a coherent barrier layer of metal coated on the interior surface, wherein said metal coating is selected from stainless steel, chromium, gold and nickel.

3. A transparent or translucent receptacle for containing biological fluids which comprises a hollow glass vessel having the interior surface coated with a coherent light transmitting barrier of stainless steel.

4. A glass receptacle in accordance with claim 3 wherein the stainless steel coating is between about 300 and 600 angstroms in thickness.

5. A glass receptacle in accordance with claim 4 wherein the receptacle is a test tube.

6. A glass receptacle in accordance with claim 4 wherein the receptacle is an erlenmeyer flask.

7. A glass receptacle in accordance with claim 4 wherein the receptacle is a breaker.

8. A glass receptacle in accordance with claim 4 wherein the receptacle is a petri dish.

9. A glass receptacle in accordance with claim 4 wherein the receptacle is a centrifuge tube.

10. A glass receptacle in accordance with claim 4 wherein the receptacle is a sealable vial.

11. A glass receptacle in accordance with claim 4 wherein the receptacle is a pipette.

12. A transparent or translucent container for biological fluids having a coherent light transmitting barrier coating of metal on the interior surface, wherein the metal coating is deposited on the surface by a sputtering technique.

13. An article in accordance with claim 12 wherein the metal coating is inert to biological fluids.

14. An article in accordance with claim 12 wherein the metal coating is stainless steel.

15. An article in accordance with claim 12 wherein the metal coating is chromium.

16. An article in accordance with claim 12 wherein the metal coating is gold.

17. An article in accordance with claim 12 wherein the metal coating is nickel.

* * * * *